US007880675B1

(12) United States Patent
Paschen et al.

(10) Patent No.: US 7,880,675 B1
(45) Date of Patent: Feb. 1, 2011

(54) MULTIPATH MITIGATION

(75) Inventors: Dean A. Paschen, Lafayette, CO (US); Matthew D. Turner, Ann Arbor, MI (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 197 days.

(21) Appl. No.: 12/336,174

(22) Filed: Dec. 16, 2008

(51) Int. Cl.
*H01Q 3/00* (2006.01)

(52) U.S. Cl. ..... 342/372

(58) Field of Classification Search ..... 342/372
See application file for complete search history.

(56) References Cited

U.S. PATENT DOCUMENTS

| | | | | |
|---|---|---|---|---|
| 4,525,716 | A | 6/1985 | Carlin | |
| 6,459,895 | B1 * | 10/2002 | Hastings et al. | 455/424 |
| 6,882,312 | B1 | 4/2005 | Vorobiev et al. | |
| 2002/0147031 | A1 | 10/2002 | Hood, III | |
| 2004/0039984 | A1 * | 2/2004 | Burkert et al. | 714/776 |
| 2004/0196172 | A1 * | 10/2004 | Wasiewicz | 342/33 |
| 2006/0012521 | A1 | 1/2006 | Small | |
| 2007/0274375 | A1 | 11/2007 | Ray et al. | |

OTHER PUBLICATIONS

Moeness G. Amin and Wei Sun, "A Novel Interference Suppression Scheme for Global Navigation Satellite Systems Using Antenna Array", IEEE Journal on Selected Areas in Communications, vol. 23, No. 5, May 2005, pp. 999-1012.

Amin Al-Ka'Bi, Marek Bialkowski and John Homer, "Mitigation of multipath propagation with the use of a non-uniform spaced adaptive array antenna", School of Information Technology and Electrical Engineering, The University of Queensland, 2005, pp. 56-59.

Seungyeun Yoo, Sangheon Kim, Dae Hee Youn, and Chungyong Lee, "Multipath Mitigation Technique Using Null-Steering Beamformer for Positioning System", MCSP Lab, School of Electrical and Electronic Eng., Yonsei University, 2003, pp. 602-605.

* cited by examiner

*Primary Examiner*—Thomas H Tarcza
*Assistant Examiner*—Harry Liu
(74) *Attorney, Agent, or Firm*—Sheridan Ross P.C.

(57) ABSTRACT

Mitigation of the effects of multipath signals is provided. Such mitigation can include electronically steering the main beam of a receive pattern associated with a phased array antenna away from a transmitting antenna. In addition, a phase taper is applied to groups of antenna elements to create a null in the main beam, bifurcating that beam. The multipath signal may be placed in or towards the null, while the direct path signal may be placed on one of the halves of the main beam adjacent the null, such that the signal strength of the multipath signal is attenuated as compared to the signal strength of the direct path signal.

21 Claims, 8 Drawing Sheets

MULTIPATH MITIGATION

FIELD

The disclosed invention is directed to the mitigation of multipath signals. More particularly, the disclosed invention is directed to the mitigation of multipath signals received by a phased array antenna.

BACKGROUND

Multipath fading is a regular phenomenon in telemetry or other communication or location determining operations, especially over water. The arrival of multipath signals at a receiving apparatus can interfere with the reception of the desired, direct path signal. In particular, in a typical multipath situation, a multipath signal is reflected from a surface, such as the surface of the ocean, before reaching the receiver. Because of the longer path traveled by the multipath signal as compared to the direct path signal, the multipath signal may be out of phase with the direct path signal. This can result in destructive interface and attenuation of the direct path signal. Moreover, where the source of the signals and the receiver are in motion relative to one another, the direct path and multipath distances change over time, resulting in a phase relationship that changes according to the difference in target and target image phase.

One standard multipath mitigation technique is to implement a beam tilt. According to this technique, the angle of the receiving antenna relative to the source of the signal is altered. For example, where the receiving antenna comprises a planer array fixed to an aircraft, tilting the beam can comprise altering the attitude of the aircraft from one that is level to one that is non-level. Although this technique can be effective, it is somewhat imprecise, and can be difficult to implement, depending on the flight conditions.

Another technique for mitigating multipath signals involves the use of a relatively large array of antenna elements. In particular, providing an array with a relatively large total aperture, particularly in the vertical dimension, creates spatial independence that can minimize fading issues. However, for reasons including aerodynamic efficiency and weight, there is a desire to reduce the size of receiving antennas. The desire to reduce the size of receiving antennas is particularly strong with respect to the vertical dimension of the antennas, especially in applications where the receiving antenna is mounted to an aircraft.

SUMMARY

In accordance with embodiments of the present invention, multipath signals can be suppressed or mitigated by providing a main beam that is tilted away from the signal transmitter. In addition, the main beam can be bifurcated, to create a null at the center of the main beam into which a multipath signal can be placed. By placing the multipath signal into the null, the strength of the multipath signal can be attenuated as compared to the strength of the direct path signal.

In accordance with embodiments of the present invention, the main beam is tilted by electronically steering that beam. For example, the main beam can be steered away from the source of the desired signal by some number of degrees in elevation from the signal source. Bifurcation of the main beam to produce a null at the beam's center can be achieved by tapering the phase of the received signal across groups of antenna elements. Tilting of the main beam and the creation of a bifurcated main beam may be performed simultaneously. Moreover, tilting of the main beam may be achieved by tilting a platform carrying the receiving antenna and/or steering the main beam electronically.

In accordance with further embodiments of the present invention, the presence of a multipath signal is detected by detecting deviations or changes in the amplitude of the received signals. More particularly, if the amplitude of the received signal exhibits changes in intensity, the presence of one or more multipath signals is indicated, and in response multipath mitigation in accordance with embodiments of the present invention is commenced. Variations in the amplitude of a received signal are monitored in connection with controlling the amount by which a receive beam is steered away from a signal source in order to mitigate the effect of a multipath signal. In particular, the beam is steered to an angle at which the statistical deviation in the amplitude of the received signal is minimized. By keeping the statistical deviation of the received signal at or near a minimum value, embodiments of the present invention also facilitate the tracking of a signal source. Variations in the amplitude of a received signal can also be monitored in connection with controlling an applied phase taper.

Additional features and advantages of embodiments of the present invention will become more readily apparent from the following detailed description, particularly when taken together with the accompanying drawings.

DETAILED DESCRIPTION

Figure 1:
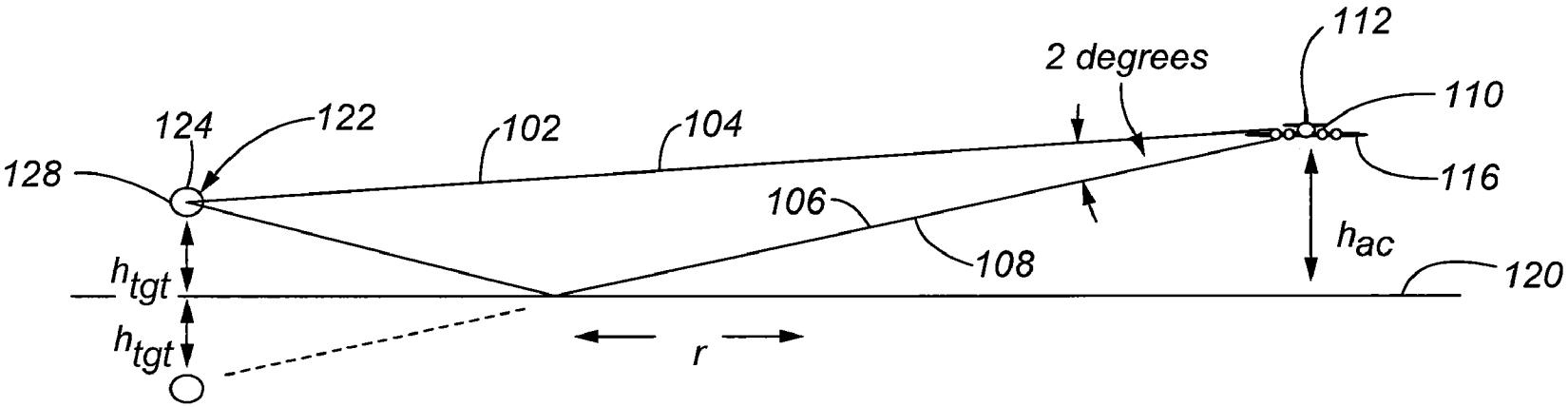
FIG. 1 is a depiction of a scenario in which a multipath signal is present.

FIG. 1 depicts a scenario in which a desired signal 102, shown as a direct path signal 104, and an interfering signal 106, shown as a multipath signal 108, are received at a receiver apparatus 110 including a phased array antenna 112. In the scenario depicted in FIG. 1, the receiver apparatus 110 including the phased array antenna 112 is deployed on a platform 116 comprising an aircraft having a height $h_{ac}$ above a reflecting surface 120. The direct 104 and multipath 108 signals are produced at a signal source 122. In the scenario depicted in FIG. 1, the signal source 122 includes a transmitting antenna 124 that is carried by a target vehicle 128 having a height $h_{tgt}$ above the reflecting surface 120. Accordingly, the depicted scenario is one in which a tracking aircraft 116 is receiving telemetry data from a signal source comprising a target vehicle 128, such as a missile, remotely piloted aircraft, or other platform. In such telemetry operations, the reflecting surface 120 is typically water, since such operations are commonly performed over the ocean.

More particularly, FIG. 1 depicts a single bounce multipath scenario that dominates most fading situations caused by the presence of multipath signals. The difference between the distance traveled by the desired or direct path signal 104 and the distance traveled by the multipath signal 108 determines the phase relationship between the two signals 104, 108 at the receiving phased array antenna 112. When the target signal source and/or receiving phased array antenna 112 are in motion relative to one another, the distances change with time, resulting in a phase relationship that wraps according to the difference in target and image velocities. Effectively, the combined signal at the receiving phased array antenna 112 can be described as two doppler-shifted signals beating against each other. More particularly, the direct path slant range is given as: $R_0=\sqrt{r^2+(h_{ac}+h_{tgt})^2}$;

and a multipath slant range is given as: $R_1=\sqrt{r^2+(h_{ac}+h_{tgt})^2}$;

for a total signal of:

$$y(t) = x(t) + \Gamma x(t-\tau), \text{ where } \tau = \frac{R_1 - R_0}{c}.$$

Figure 2:
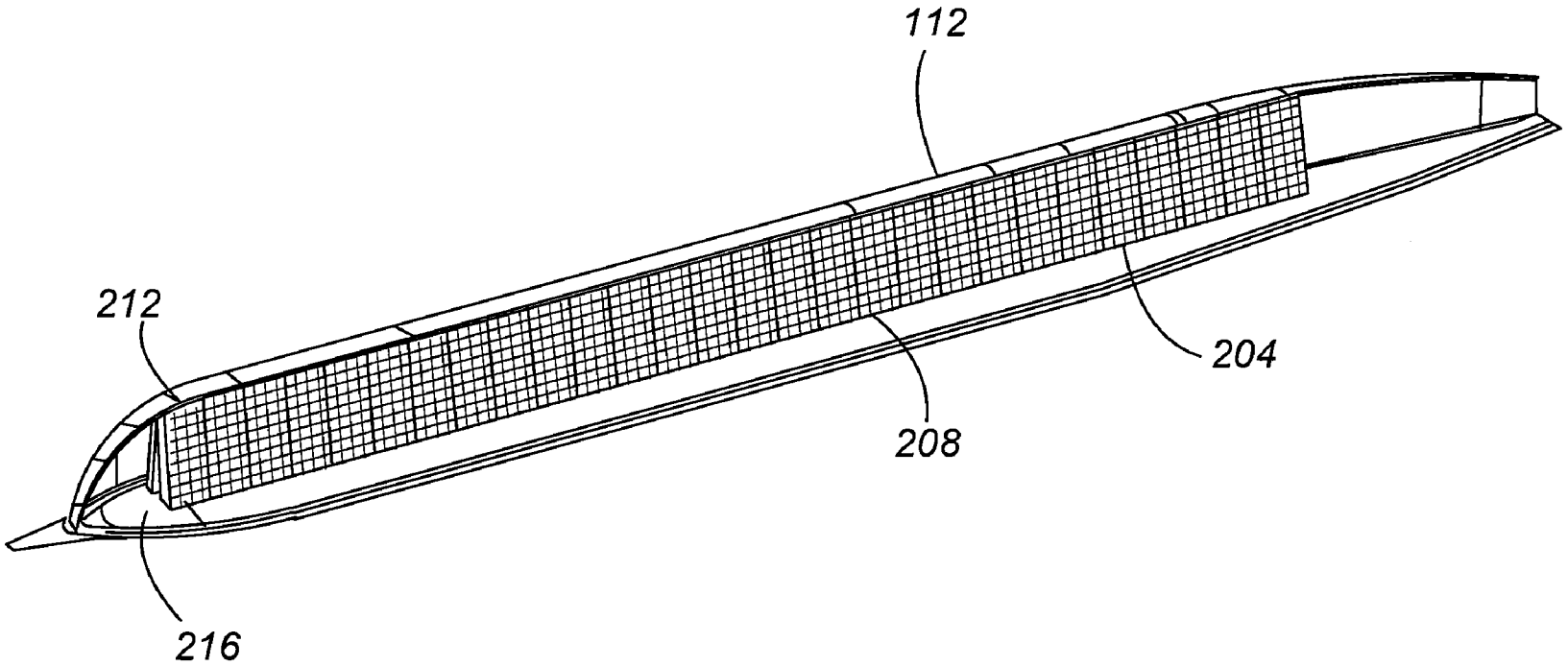
FIG. 2 is a depiction of a phased array antenna in accordance with embodiments of the present invention.

FIG. 2 depicts a phased array antenna 112 in accordance with embodiments of the present invention. In particular, the phased array antenna 112 includes a plurality of panels or sections 204 containing a plurality of antenna elements 208. In the embodiment illustrated, the phased array antenna 112 is particularly suited to deployment on a vehicle comprising an aircraft 116. Specifically, the embodiment depicted in FIG. 2 is enclosed within a radome 212 formed along the top of the fuselage 216 of the aircraft 116. Although the particular phased array antenna 112 depicted in the example scenario is carried on an aircraft 116 and is used to track an airborne target 128, it should be appreciated that embodiments of the present invention are not limited to such use. For example, the phased array antenna 112 may be carried by any type of vehicle 116, or may be part of a fixed installation. Similarly, the signal source 122 may be deployed on a target 128 comprising any type of vehicle, or the transmitting antenna 124 may be part of a stationary installation. In addition, embodiments of the present invention are not limited to telemetry operations. In particular, embodiments of the present invention may have application to any situation in which a phased array antenna 112 is used to receive a desired signal 102 having a first angle of arrival with respect to the receiving phased array antenna 112 and an interfering signal 106 having a second angle of arrival with respect to the receiving phased array antenna 112.

Figure 3:
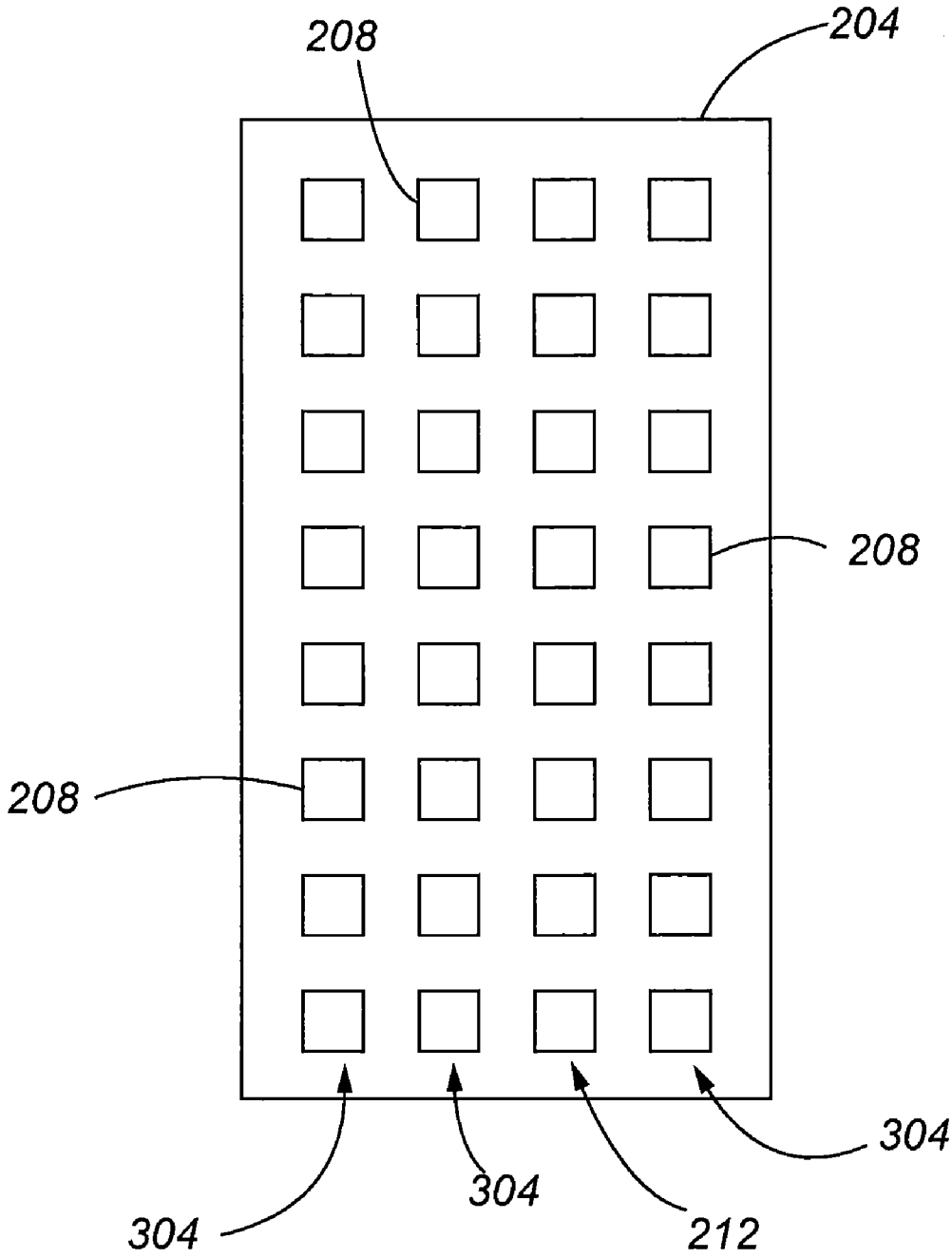
FIG. 3 is a depiction of a section of a phased array antenna in accordance with embodiments of the present invention in plan view.

FIG. 3 depicts a section 204 of a phased array antenna 112 in accordance with embodiments of the present invention. As shown, the section 204 includes a plurality of radiator or antenna elements 208. Individual antenna elements 208 or groups 304 of antenna elements 208 may be controlled to steer the beam pattern of the receiving antenna, as is conventional in phased array antenna designs. For example, when used in connection with tracking a target 128 from an airplane 116, the antenna elements 208 may be controlled so that a signal received at each row of antenna elements 208 is delayed a different amount than any other row to allow steering of the receive beam pattern produced by the complete phased array antenna 112 to be steered in elevation. Moreover, each group 304 may comprise a column of antenna elements 208.

Figure 4:
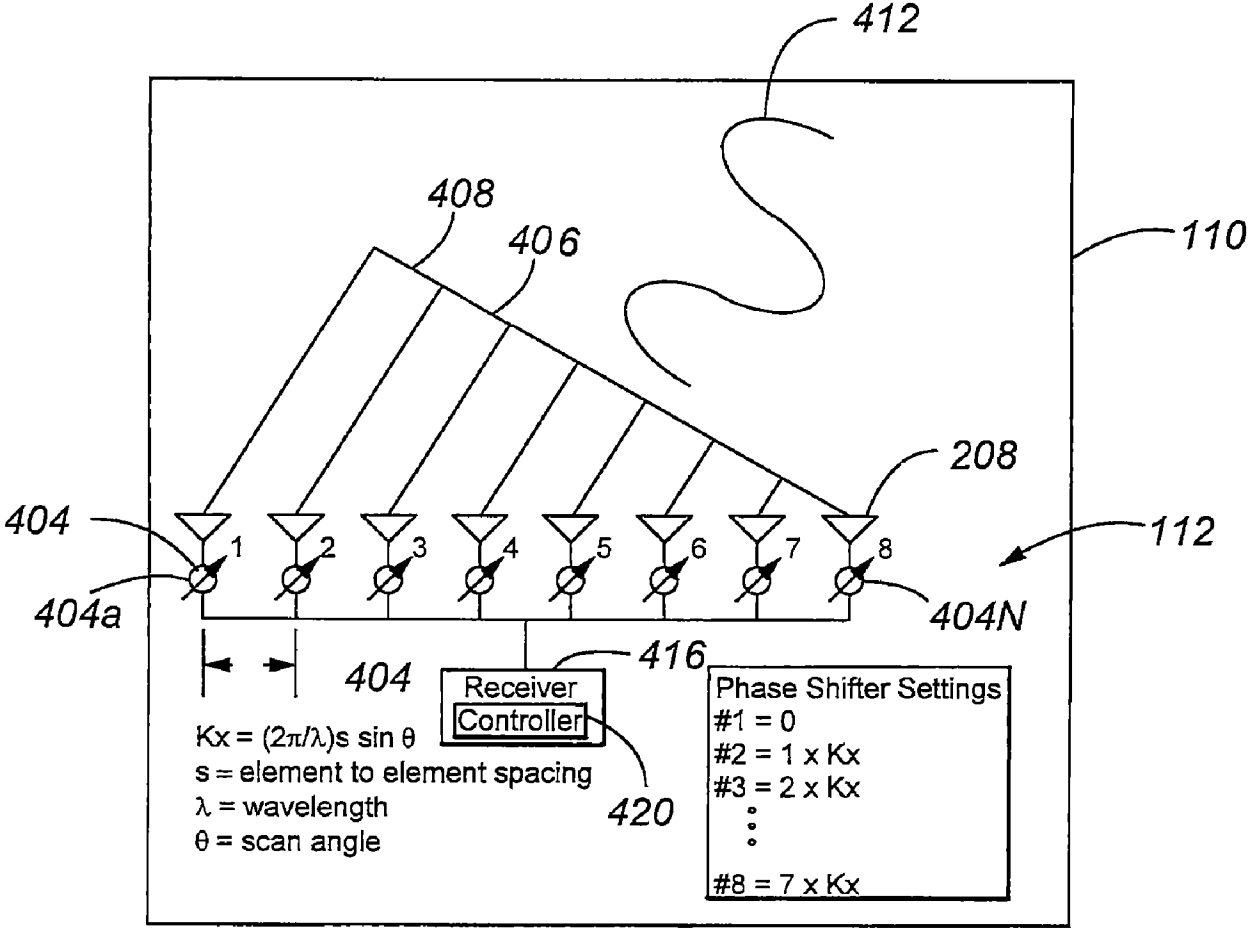
FIG. 4 depicts components of a phased array antenna in accordance with embodiments of the present invention.

FIG. 4 depicts components of a phased array antenna 112 and shows the steering of a phased array antenna 112 beam pattern. In particular, FIG. 4 illustrates a portion of a receiver apparatus 110 that includes a phased array antenna in which a phase shifter 404 is associated with each antenna element 208. Line 406 depicts the wave front of a receive beam pattern 408 that has been steered in the direction of the source of an incoming signal 412. In order to steer the receive beam 408 as shown, the first phase shifter **404*a* may be set to introduce a smaller amount of delay than any of the other phase shifters 404. Going from the first phase shifter 404*a* to the last phase shifter 404N, the amount of delay introduced is increased, until the maximum is reached at the last phase shifter 404N. The received signal 412, which typically corresponds to a direct path signal 104, but in multipath situations additionally or alternatively comprises a multipath signal 108, is passed by the phase shifters 404 to a receiver 416. In accordance with embodiments of the present invention, the receiver 416 includes or is associated with a controller 420. The controller 420 may execute application code or firmware instructions for controlling operation of the phase shifters 404, in order to steer the receive beam 408 in the desired direction. In addition, as described in the present disclosure, the controller 420 may execute application code or instructions for controlling the phase shifters 404 to effect the bifurcation of the main or center lobe of the receive beam 408, in addition to steering the beam 408, in order to mitigate the effect of a multipath signal 108 or multipath signals 108 at the receiving phased array antenna 112**.

Figure 5:
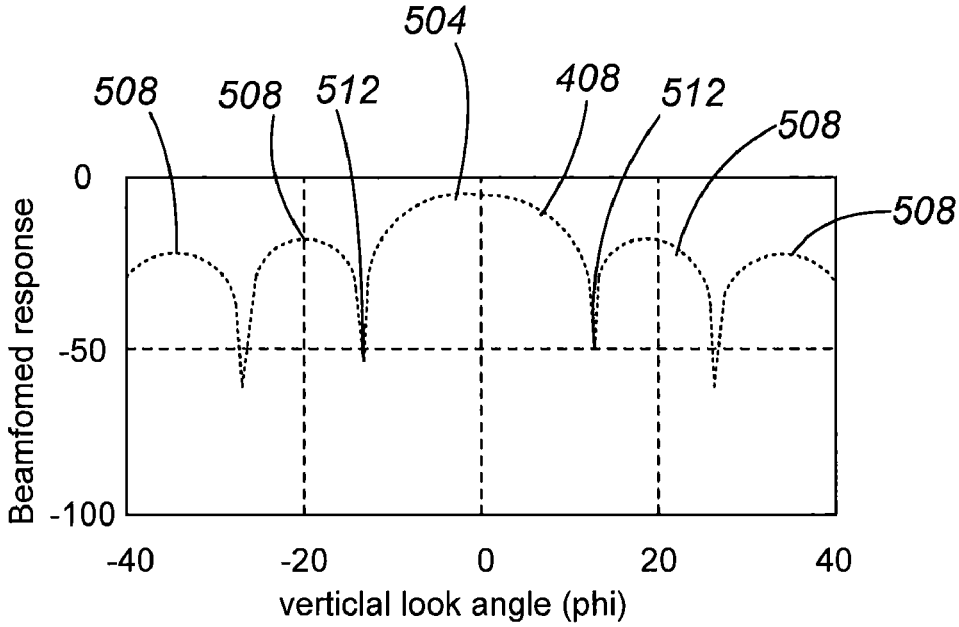
FIG. 5 depicts the response of a phased array antenna in a normal operating mode in accordance with embodiments of the present invention.

FIG. 5 depicts the receive beam 408 of a phased array antenna 112 in accordance with embodiments of the present invention, while that phased array antenna 112 is operated in a normal mode. Characteristic of the pattern is a main beam or lobe 504, with side lobes 508 on either side. As can be appreciated from the figure, if a multipath signal is received at a relatively small (e.g., less than 15 degrees) angle from the boresight of the pattern 408 of the phased array antenna 112, the multipath signal 108 will largely be unattenuated as compared to a direct path signal 104 received along the boresight of the beam pattern 408. As a result, the observed signal strength at the receiver 416 may be severely attenuated. As used herein, boresight is defined as pointed directly at the signal source 122 such that the angle between the center of the main beam 504 and the signal source is effectively zero. Moreover, in accordance with embodiments of the present invention, the signal source 122 is considered to lie in the boresight of the main beam 504 so long as the angle between the center of the main beam and the signal source 122 is effectively 0 degrees in elevation, without regard to the angle between the center of the main beam and the signal source 122 in azimuth.

The inventors of the present invention have recognized that the strength of an interfering signal 106, such as a multipath signal 108, as received at a receiver 416 by an array of antenna elements 208, can be attenuated as compared to a desired signal 102, such as a direct path signal 104, by electronically steering the receive beam 408 of the phased array antenna 112 away from the transmitting antenna 124, such that the transmitting antenna 124 is not in or aligned with the boresight of the main beam 504 of the receiving phased array antenna 112. In particular, such steering of the receive beam 408 can effectively place the interfering signal 106 in or approaching a null 512 between the main beam 504 and an adjacent side lobe 508, causing a relatively greater attenuation of the interfering signal 106 than is experienced by the desired signal 106 by moving the receive beam 408 a small number of degrees (e.g., 4 degrees). Moreover, the inventors of the present invention have recognized that the presence of a multipath signal is indicated by changes in the amplitude of a desired signal, and that the amount by which the receive beam is steered should be to the point at which variations in the amplitude of the received signal are reduced or minimized.

Figure 6:
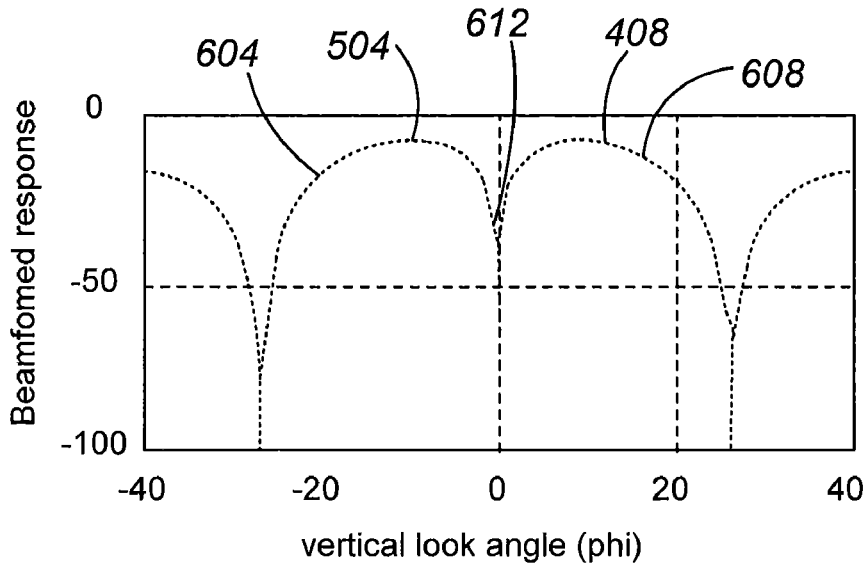
FIG. 6 depicts the response of a phased array antenna in a multipath mitigation mode in accordance with embodiments of the present invention.

In addition, the inventors of the invention disclosed herein have recognized that the effect of an interfering signal 106 can be further mitigated by bifurcating the main beam 504 of the received pattern 408. With reference now to FIG. 6, a receive pattern 408 of a phased array antenna 112 with a bifurcated main beam 504 is illustrated. In particular, bifurcation of the main beam 504 results in the creation of a main null 612 in the center of the main beam 504, which in turn separates the main beam 504 into first 604 and second 608 main beam halves. Bifurcation of the receive pattern 408 may thus form an additional null (the main null 612) in which an interfering signal 106, such as a multipath signal or signals 108, can be placed, to attenuate those interfering signals 106 relative to the desired signal 102, such as a direct path signal 104. In addition, the main beam 504 can be steered so that the direct path signal 104 falls on one of the halves 604 or 608 of the bifurcated main beam 504, while the multipath signal 108 falls in or further towards the main null 612. In FIG. 6, the main beam 504 has not been steered off axis, and therefore the vertical look angle (i.e., the angle of the signal source 122 in elevation) is shown as 0°.

Figure 7:
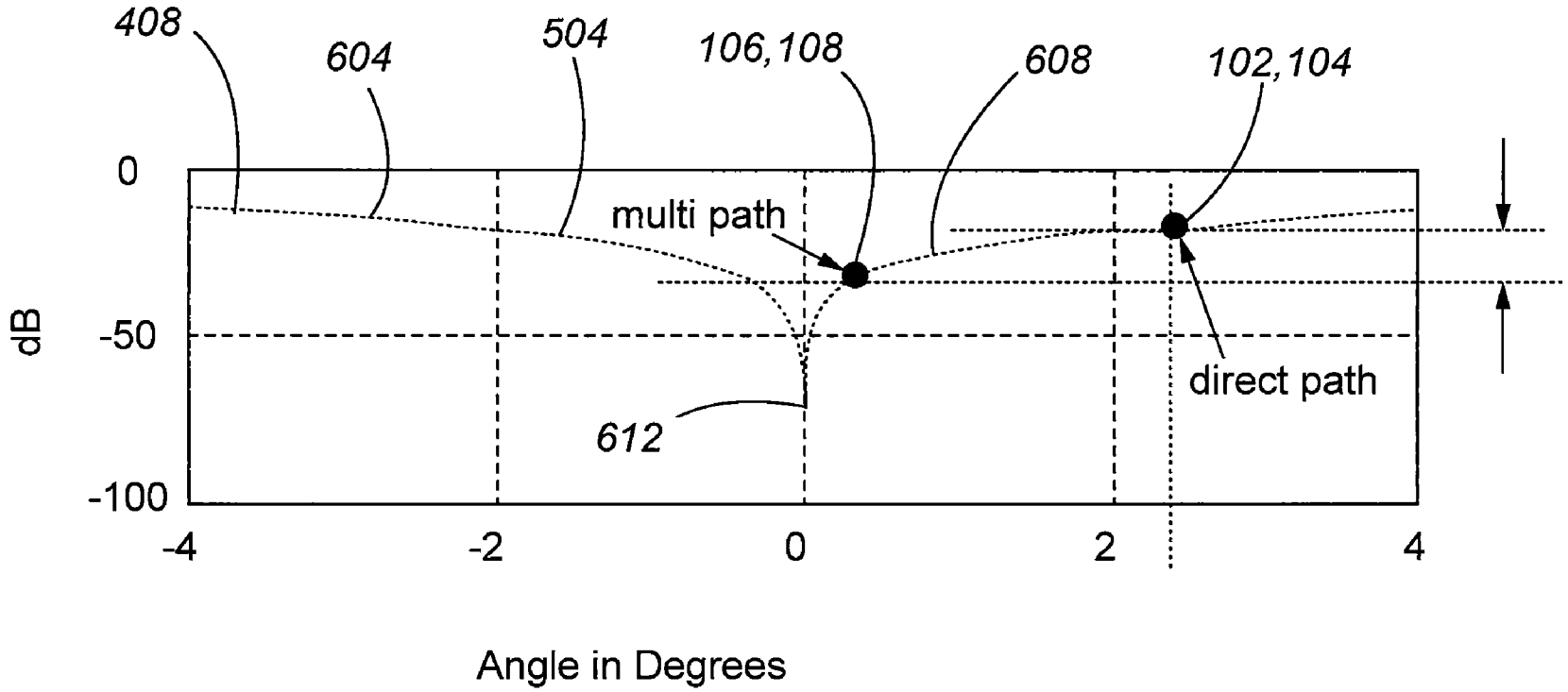
FIG. 7 depicts a detail of the response of a phased array antenna in a multipath mitigation mode and the receipt of direct path and multipath signals in accordance with embodiments of the present invention.

With reference now to FIG. 7, a detail of the main null and surrounding portions of the bifurcated main beam is illustrated. The center of the main beam 504 of the receive pattern 408, which corresponds to the main null 612, has been steered just over two degrees away from the signal source 122 or transmitting antenna 124, as can be seen by the location in degrees at which the desired signal 102 (e.g., the direct path signal 104) is received. The interfering signal 106 (e.g., the multipath signal 108) is received nearer to the boresight of the receive pattern 408, and thus nearer the minima of the main null 612. As a result of this relative placement of the desired 102 and interfering 106 signals, here corresponding to direct path 104 and multipath 108 signals, the interfering signal 106 is attenuated as compared to the desired signal 102. For example, as shown in FIG. 7, the attenuation of the multipath signal 108 compared to the direct path signal 104 is about 18 dB with the main beam 504 steered such that the direct path signal is 2.4 degrees away from boresight.

In order to achieve a bifurcation of the main beam 504 of a receive pattern 408, and thus create a main null 612, the receive signal with respect to a column or group 212 of antenna elements 208 is tapered. The taper of the received signals may vary from −90° to +90° across the group 212 of antenna elements 208 comprising the column. Such a phase taper may be introduced with respect to the receive signal for a particular desired signal 102 or direct path signal 104 and for each of a plurality of columns or groups 212 of antenna elements 208 included in the phased array antenna 112. This phase taper is applied in addition to any phase delay introduced as part of steering the beam pattern 208. For example, in a phased array antenna 112 comprising eight antenna elements having an interelement spacing of 0.55 wavelengths, the following delays may be introduced across the elements 208 of a column using the associated phase shifters 404, while steering the main beam 2.4 degrees, for a desired signal 102, with close (e.g., from 0° to 4°), mid-level, and far (e.g., greater than 10°) spacing between the direct path signal and the multipath signal as follows:

| Element | Amount of Relative Phase Shift (Close spacing) | Amount of Relative Phase Shift (Mid-level spacing) | Amount of Relative Phase Shift (Large spacing) |
|---|---|---|---|
| 1 | −90.0000 | −45.0000 | 0 |
| 2 | −90.3456 | −22.5858 | 44.8770 |
| 3 | −90.6912 | −0.1715 | 89.7539 |
| 4 | −91.0367 | 22.2427 | 134.6309 |
| 5 | 88.6177 | 134.6569 | 179.5078 |
| 6 | 88.2721 | 157.0712 | 224.3848 |
| 7 | 87.9265 | 179.4854 | 269.2618 |
| 8 | 87.5810 | 201.8997 | 314.1387 |

In general, the beam is steered by introducing a phase delay equal to $$\frac{2\pi d}{\lambda} \times \sin(\theta),$$

where d is the spacing between elements, λ is the wavelength of the desired signal, and θ is the desired steering angle. In order to introduce a null that creates a bifurcated main beam, a difference pattern is formed in the direction of the multipath.

Figure 8:
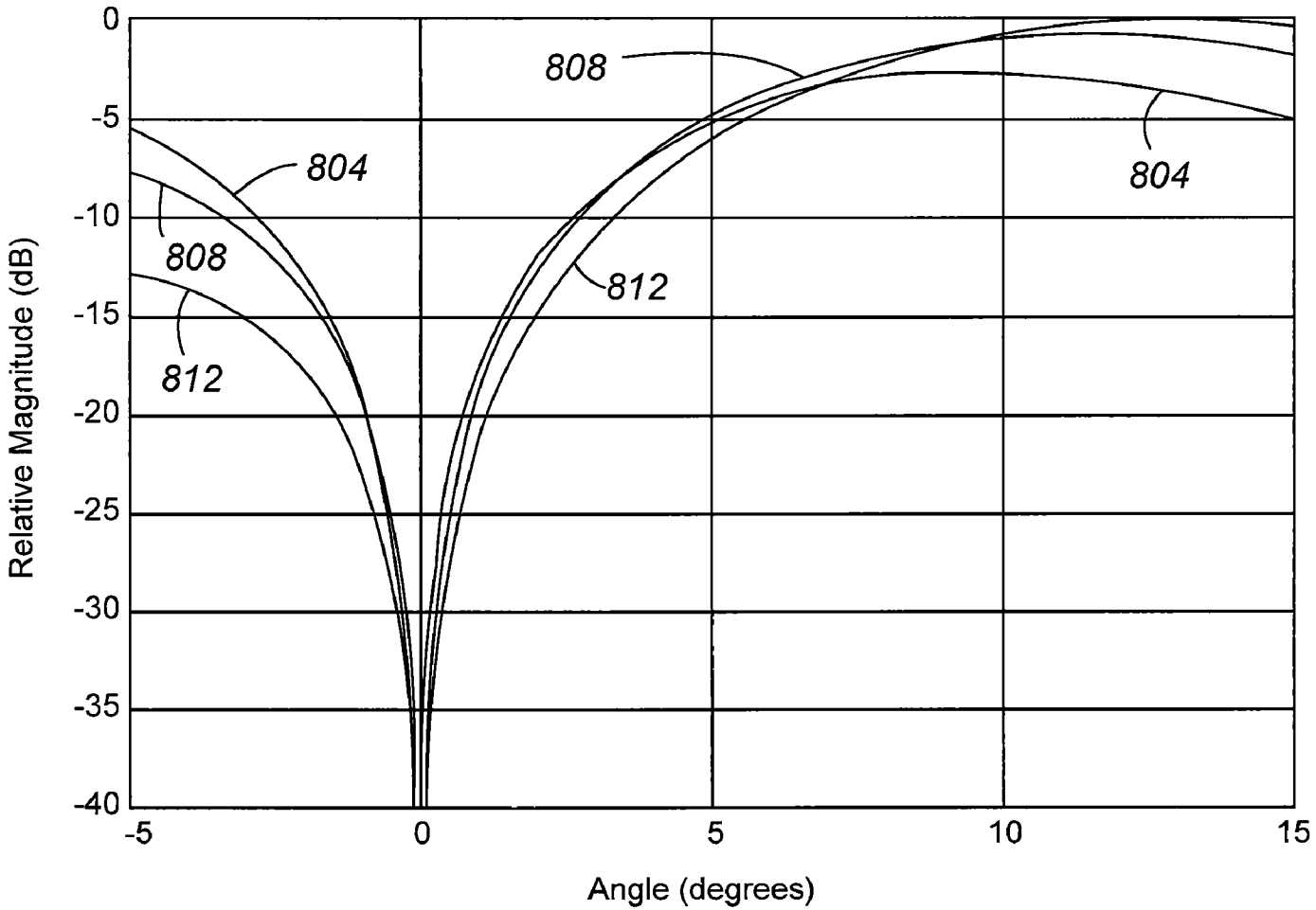
FIG. 8 is a plot depicting exemplary antenna beam patterns in accordance with embodiments of the present invention.

The particular difference pattern or null adjacent to the main beam that is applied can be chosen based on the distance of the multipath signal from the direct path signal in degrees. For example, the close spacing difference pattern 804 (see FIG. 8), where the additional applied phase extends from about −90° to about +90°, in addition to the amount of any applied phase delay for the desired steering angle, in the example above is appropriate where the distance between the multipath signal and the direct path signal is relatively close, because the beam pattern 804 rises from the null (at 0° or along boresight) relatively steeply, but is inappropriate for relatively large angles between the multipath signal and the direct signal, because that pattern falls away after about 10° from boresight. The mid-level spacing 808, where the additional applied phase extends from about −45° to about +45°, in addition to the desired steering angle is appropriate for distances between the multipath and direct path signals from about 4° to about 10°. The example for a large spacing 812 between the multipath and direct path signals (e.g., greater than 10°) is for an unmodified beam steered about 13° from boresight. In this example, the difference in phase between adjacent elements is due solely to the steering of the beam, as no additional taper or difference pattern is applied.

Figure 9:
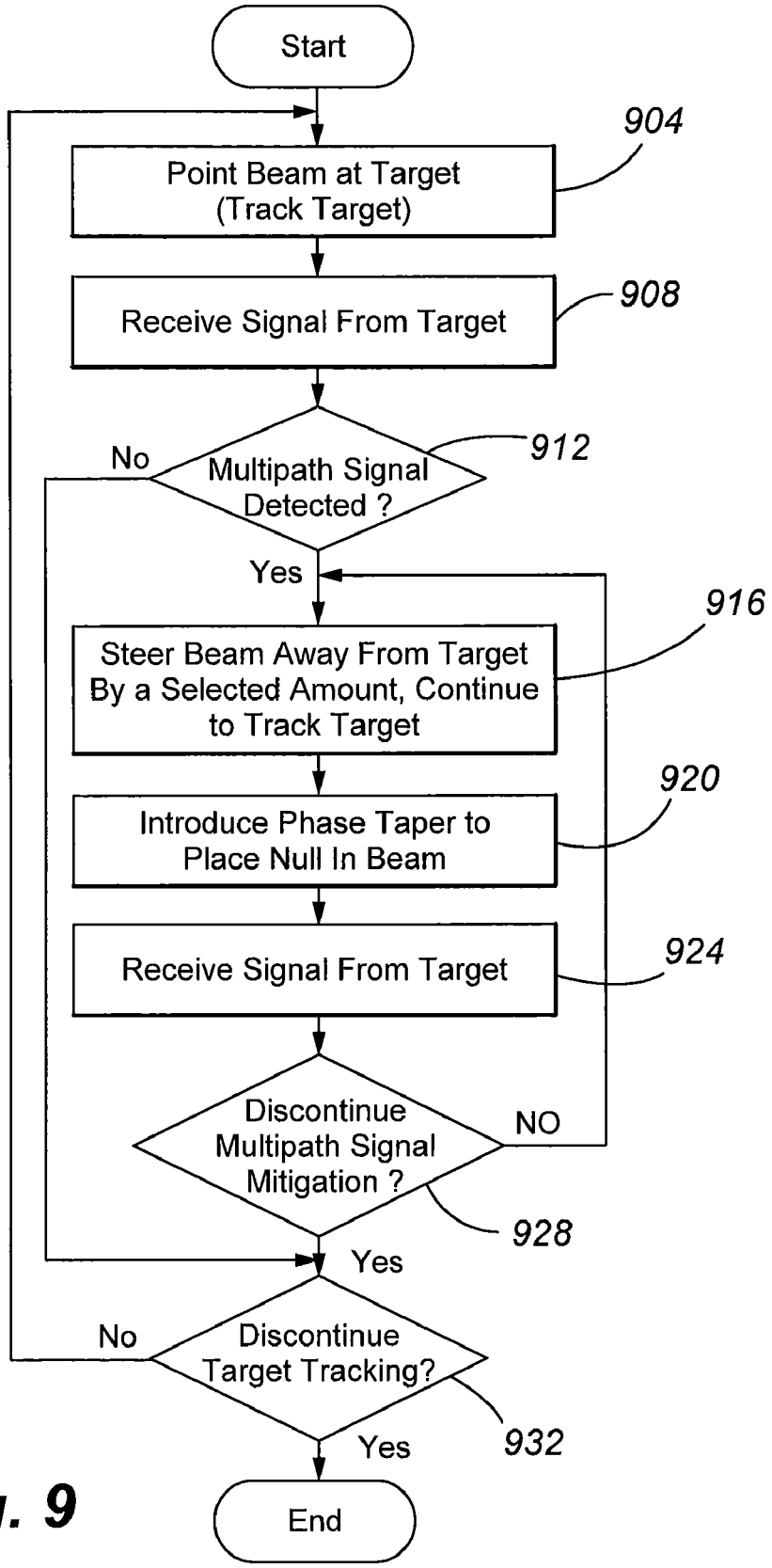
FIG. 9 is a flowchart depicting aspects of the operation of a phased array antenna in accordance with embodiments of the present invention.

FIG. 9 is a flowchart depicting aspects of a method or process for mitigating the effect of interfering signals 106 such as multipath signals 108 at a receiving phased array antenna 112 in accordance with embodiments of the present invention. After starting the system, the main beam 504 of the phased array antenna 112 receive pattern 408 is pointed at the target 128, and thus at the transmitting antenna 124 (step 904). Pointing the beam 504 at the target 128 can include electronic or mechanical pointing of the main beam 504, and/or aligning a vehicle such as an aircraft 116 carrying the phased array antenna 112 such that the center of the main beam 504 is pointed at the target 128 such that the relative angle between the center of the main beam 504 and the signal source is effectively 0°, at least in elevation. At step 908, a signal is received from the signal source 122 on the target 128. The signal received by the phased array antenna 112 can include a direct path signal 104, and may additionally include a multipath signal 108.

At step 912, a determination is made as to whether an interfering signal 106, such as a multipath signal 108, is detected at the phased array antenna 112. In accordance with embodiments of the present invention, detection of an interfering signal 106 can be performed by detecting a loss of signal strength with respect to a received desired signal 102, such as a direct path signal 104. More particularly, the presence of a multipath signal may be indicated by a pulsing or cycling in the amplitude of the received signal. Additionally or alternatively, an interfering signal 106 can be detected by detecting an increase in a bit error rate in the information provided by the desired signal 102.

If an interfering signal 106 is detected at step 912, the main beam 504 is steered away from the target 128 and thus the signal source 122 by a selected amount, and the target 128 continues to be tracked, while maintaining the offset introduced by steering the beam 504 away from the target 128 (step 916). Steering the main beam 504 can include introducing different delay amounts with respect to signals received by a group 212 of antenna elements 208 using the phase shifters 404 associated with those elements 208. Additionally or alternatively, steering the main beam 504 away from the target by a selected amount can include mechanically steering the phased array antenna 112 or tilting or otherwise changing the attitude of the aircraft or other vehicle 116 or support associated with the phased array antenna 112. As an example, steering the main beam 504 away from the target 128 can include moving the main beam 504 such that the boresight of that beam is no longer centered on the target 128, and is instead moved some number of degrees away from the target 128. Moreover, in a typical scenario, the beam 504 is steered in elevation, especially in scenarios where the reflecting surface 120 comprises a body of water or land. The amount by which the beam is steered may be selected by determining the amount of steering that results in the greatest improvement in the received signal. For example, the amount by which the beam is steered may be that amount that results in the least variation in amplitude of the received signal.

Additionally or alternatively, a phase taper may be introduced across groups of phase shifters 404 to create a null 612 in the main beam 504 (step 920). The phase taper may comprise adjusting the relative phase delay for signals received by a group 212 of antenna elements 208 across a range from zero to 180 degrees. Stated another way, the phase delay with respect to signals received by a group of antenna elements may be from −90° to +90°. By introducing such a phase taper using the phase shifters 404 associated with the antenna elements 208 in the group, a central null 612 is created, bifurcating the main beam 504. The multipath signal 108 or other interfering signal 106 can then be placed in or towards the null 612, reducing the effect of destructive interference with the desired signal 102. Thus, as the desired signal 102 continues to be received from the target 128 (step 924), the effect of the multipath signal 108 is diminished. In accordance with further embodiments of the present invention, the phase taper amount may comprise a smaller phase taper than a full difference pattern between elements. For example, the phase taper or phase step across elements may be from about +45° to about −45°. As still another alternative, it may be determined that it is preferable that no additional phase taper be imposed in addition to the taper applied in order to steer the beam. The selection of a particular difference pattern or related phase taper (or no difference pattern) may be made by applying each phase taper, and selecting the pattern choice that results in the greatest improvement in the received signal amplitude.

As shown in FIG. 7, the application of a phase taper to create a null 612 in the main beam 504 can result in some reduction in the signal strength with respect to the desired signal 102 as compared to the signal strength of the direct signal 104 using a conventional main beam 504 (i.e., prior to application of a phase taper). However, the creation of the null 612 and placement of the multipath signal 108 in or towards that null 612 (e.g., by steering the beam 504) creates a situation in which the signal strength of the interfering signal 106 is significantly less (e.g., 15 dB less) than the signal strength of the desired signal 102. Nonetheless, it may still be desirable to discontinue the multipath mitigation measures in the absence of interfering signals 106. Accordingly, at step 928, a determination can be made as to whether interfering or multipath signal mitigation should be discontinued. If interfering or multipath signal mitigation should be continued (e.g., significant multipath signals 108 continue to be detected), the process may return to step 816, where the main beam 504 continues to be steered or aligned relative to the target 128 such that the target 128 and thus the transmitting antenna 124 is not in the boresight of the main beam 504, and the phase taper creating the null 612 can continue to be applied. If it is determined that multipath signal mitigation can be discontinued, a determination may next be made as to whether target tracking should be discontinued (step 932). If target tracking is not to be discontinued, the process may return to step 904, and the beam 504 may be pointed directly at the target 128. If target tracking is discontinued, the process may end.

In accordance with embodiments of the present invention, determining whether to discontinue multipath signal mitigation can be performed by momentarily discontinuing mitigation techniques and detecting parameters associated with the received direct path 104 and/or multipath 108 signal at the phased array antenna. In particular, if the strength of the received signal is diminished or is associated with a high bit error rate, mitigation measures can be immediately continued. Such a check may be performed periodically. Multipath may be indicated where the signal strength is reduced, is dropping, and/or is bouncing.

As can be appreciated by one of skill in the art after appreciation of the present disclosure, a phased array antenna 112 using a phase taper to mitigate the effects of multipath signals 108 can apply that phase taper with respect to multiple (e.g., all) groups 212 of antenna elements 208 included in the array. In accordance with other embodiments of the present invention, a striping technique is applied, according to which a phase taper to create a null 612 in the main beam 504 is applied to every other group of antenna elements 208 by the associated phase shifters 404. Although certain portions of the description have discussed the mitigation of the effects of a multipath signal 108 on a direct path signal, it should be appreciated that embodiments of the described invention have application to mitigating the attenuation of any undesired signal 106 on a desired signal 102.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with the various modifications required by their particular application or use of the invention. It is intended that the appended claims be construed to include alternative embodiments to the extent permitted by the prior art.

What is claimed is:

1. A method for suppressing multipath signals, comprising:

directing a beam of a phased array antenna towards a source of a desired signal;

after directing the beam of the phased array antenna towards a source of the desired signal, detecting an interfering signal received by the phased array antenna;

in response to detecting the interfering signal:

tilting the beam with respect to the source of the desired signal in at least one of elevation and azimuth, wherein the source of the desired signal is not aligned with the boresight of the beam; and determining an amount of phase taper to be applied across a plurality of antenna elements.

2. The method of claim 1, wherein tilting the beam with respect to the source of the desired signal includes electronically steering the beam of the phased array antenna with respect to the source of the desired signal.

3. The method of claim 1, wherein the beam of the phased array antenna is formed from a first set of antenna elements included in the plurality of antenna elements, wherein the phase taper is applied across a plurality of antenna elements and includes varying a phase taper over a range of between 0 to 180 degrees from a first element in the first set of elements to a last element in the first set of elements included in the first set of elements in addition to any phase taper for steering the beam.

4. The method of claim 1, wherein the phase taper is applied and results in a null in a main beam pattern of the phased array antenna, bifurcating the main beam.

5. The method of claim 4, wherein the interfering signal is placed nearer a center of the null than the desired signal, and wherein the strength of the interfering signal is attenuated as compared to the strength of the desired signal.

6. The method of claim 4, wherein tilting the beam away from the source of the desired signal includes electronically steering the beam of the phased array antenna away from the source of the desired signal.

7. The method of claim 4, wherein a first series of phase taper is applied with respect to a desired signal in a first frequency range, and wherein a second series of phase taper is applied with respect to a desired signal in a second frequency range.

8. The method of claim 7, wherein tilting the beam away from the source of the desired signal includes electronically steering a beam of the phased array antenna away from the source of the desired signal, and wherein the beam is steered away from the source of the desired signal by a first amount with respect to a desired signal in the first frequency range, and wherein the beam is steered away from the source of the desired signal by a second amount with respect to a desired signal in the second frequency range.

9. The method of claim 1, wherein the interfering signal is detected as an attenuation of an amplitude of the desired signal.

10. The method of claim 1, wherein the interfering signal is detected as a change of an amplitude of the desired signal over time.

11. The method of claim 1, wherein the interfering signal is detected as an increase in an observed bit error rate associated with the desired signal.

12. The method of claim 1, wherein detecting the interfering signal includes obtaining a first measure of the desired signal prior to tilting a receive pattern main beam away from the source of the desired signal and prior to introducing a phase taper across a plurality of elements, wherein tilting a receive pattern of the main beam away from the source of the desired signal includes tilting the main beam with respect to the source of the desired signal by a first amount, and wherein the phase taper is applied across a plurality of antenna elements and includes introducing a first phase taper across a plurality of antenna elements, the method further comprising:

after tilting a receive pattern main beam with respect to the source of the desired signal by a first amount and after introducing a first phase taper across a plurality of antenna elements, obtaining a second measure of the desired signal;

in response to determining that the second measure of the desired signal indicates that an amount of interference with the desired signal is unacceptable, one of:

tilting a receive pattern of the main beam with respect to the source of the desired signal by a second amount; and introducing a second phase taper across the plurality of antenna elements.

13. The method of claim 1, wherein tilting the beam with respect to the source of the desired signal includes tilting a mean beam of a receive pattern of the phased array antenna away from a line pointing directly at the source of the desired signal.

14. The method of claim 1, wherein the desired signal is a direct path signal, and wherein the interfering signal is a multipath signal.

15. An antenna system, comprising:

a plurality of antenna elements;

a plurality of phase shifters, wherein each antenna element is associated with at least one phase shifter;

a controller, wherein in a first mode of operation the controller operates the plurality of phase shifters to point a main beam in a first direction, wherein a center of the main beam is pointed in the first direction, wherein in a second mode of operation the controller operates the plurality of phase shifters to point the main beam in a second direction that is at a small angle to the first direction and operates at least a first group of phase shifters included in the plurality of phase shifters such that a phase introduced by each phase shifter in the group relative to any other phase shifter in the group is different by some number of degrees, wherein the main beam is bifurcated, wherein an interfering signal is received at a first angle to the center of the main beam and is placed in a first null associated with the bifurcated beam, and wherein a desired signal is received at a second angle to the center of the main beam, and wherein the second angle is greater than the first angle.

16. The system of claim 15, wherein in the second mode of operation the controller operates the plurality of phase shifters to point the main beam in the second direction, and wherein in the third mode of operation the controller operates the at least a first group of phase shifters included in the plurality of phase shifters such that a phase introduced by each phase shifter in the group relative to any other phase shifter in the group is different by some number of degrees, wherein the main beam is bifurcated.

17. The system of claim 15, wherein the plurality of antenna elements are included in an array of elements having a plurality of groups of phase shifters.

18. A method for mitigating multipath signals, comprising:

pointing a main beam of a phased array antenna beam pattern at a signal source;

receiving a direct path signal from the signal source;

receiving a multipath signal;

in response to receiving the multipath signal, at least one of:

electronically steering the main beam away from the signal source, wherein a center of the main beam is at a non-zero angle to the signal source; or using a plurality of phase shifters, bifurcating the main beam by introducing a phase taper with respect to a signal received by the elements in a group of elements.

19. The method of claim 18, wherein at least one phase shifter included in the plurality of phase shifters is associated with each element in the group of elements, and wherein introducing a phase taper with respect to a signal received by the elements in a group of elements includes adjusting a phase delay introduced by the phase shifters associated with the elements in the group of elements.

20. The method of claim 18, further comprising:

monitoring an amplitude of a signal received including the direct path signal and the multipath signal at the phased array antenna;

detecting a deviation in the amplitude of the received signal;

in response to detecting the deviation in the amplitude of the signal received at the phased array antenna, generating an output indication that a multipath signal is being received at the phased array antenna.

21. The method of claim 20, further comprising:

in response to the output indicating that a multipath signal is being received at the antenna, electronically steering the phased array antenna and bifurcating the main beam by introducing a phase taper to reduce the deviation in the amplitude of the received signal.

* * * * *